US006471851B1

(12) United States Patent
Bennett

(10) Patent No.: US 6,471,851 B1
(45) Date of Patent: Oct. 29, 2002

(54) CATHODIC PROTECTION SYSTEM

(76) Inventor: Jack E. Bennett, 10039 Hawthorn, Chardon, OH (US) 44024

( * ) Notice: Subject to any disclaimer, the term of this patent is extended or adjusted under 35 U.S.C. 154(b) by 803 days.

(21) Appl. No.: 08/839,292

(22) Filed: Apr. 17, 1997

Related U.S. Application Data

(63) Continuation-in-part of application No. 08/731,248, filed on Oct. 11, 1996, now abandoned.

(51) Int. Cl.[7] ..... C23F 13/00

(52) U.S. Cl. ..... 205/730; 204/196.1; 204/196.36; 205/731; 205/734

(58) Field of Search ..... 204/196, 197; 205/724, 730–739

(56) References Cited

U.S. PATENT DOCUMENTS 3,314,874 A * 4/1967 Flournoy ..... 204/404
4,506,485 A * 3/1985 Apostolos ..... 204/196
5,141,607 A * 8/1992 Swiat ..... 205/734
5,174,871 A * 12/1992 Russell ..... 204/196
5,183,694 A * 2/1993 Webb ..... 205/734
5,254,228 A * 10/1993 Westhof et al. ..... 204/196
5,292,411 A 3/1994 Bartholomew et al.
5,296,120 A * 3/1994 Bennett et al. ..... 204/284
5,364,511 A * 11/1994 Moreland et al. ..... 204/197
5,366,670 A * 11/1994 Giner et al. ..... 204/196
5,505,826 A * 4/1996 Haglin et al. ..... 205/731
5,650,060 A * 7/1997 Huang et al. ..... 205/730

OTHER PUBLICATIONS

Applegate, "Cathodic Protection", (1960), pp. 29, 45–47.*

* cited by examiner

*Primary Examiner*—T. Tung
(74) *Attorney, Agent, or Firm*—Tarolli, Sundheim, Covell, Tummino & Szabo L.L.P.

(57) ABSTRACT

Humectants are applied to cathodic protection systems which utilize thermally-sprayed zinc or zinc alloy anodes applied to the surface of reinforced concrete structures. The humectants are deliquescent or hygroscopic organic or inorganic salts, hydrophilic polymers or colloids, or organic liquid desiccants. The humectants are positioned at or near the interface between the anodes and the concrete and increase the moisture content at the interface. This increases the ability of the anode to deliver cathodic protection current to steel embedded in the concrete. The humectants may be applied to the concrete surface prior to application of the anode, or may be applied subsequent to installation of the anode.

4 Claims, 2 Drawing Sheets

CATHODIC PROTECTION SYSTEM

This application is a continuation-in-part of prior application Ser. No. 08/731,248 filed Oct. 11, 1996, now abandoned.

BACKGROUND OF THE INVENTION

1. Technical Field

This invention relates generally to the field of cathodic protection systems for steel-reinforced concrete structures, and is particularly concerned with the performance of cathodic protection systems utilizing thermally sprayed zinc or zinc alloy anodes.

2. Description of the Prior Art

The problems associated with corrosion-induced deterioration of reinforced concrete structures are now well understood. Steel reinforcement has generally performed well over the years in concrete structures such as bridges, buildings, parking structures, piers, and wharves, since the alkaline environment of concrete causes the surface of the steel to "passivate" such that it does not corrode. Unfortunately, since concrete is inherently somewhat porous, exposure to salt results in the concrete over a number of years becoming contaminated with chloride ions. Salt is commonly introduced to the concrete in the form of seawater, set accelerators or deicing salt.

When the chloride contamination reaches the level of the reinforcing steel, it destroys the ability of the concrete to keep the steel in a passive, or non-corrosive state. It has been determined that a chloride concentration of 0.6 Kg per cubic meter of concrete is a critical value above which corrosion of steel can occur. The products of corrosion of the steel occupy 2.5 to 4 times the volume of the original steel, and this expansion exerts a tremendous tensile force on the surrounding concrete. When this tensile force exceeds the tensile strength of the concrete, cracking and delaminations develop. With continued corrosion, freezing and thawing, and traffic pounding, the utility or the integrity of the structure is finally compromised and repair or replacement becomes necessary. Reinforced concrete structures continue to deteriorate at an alarming rate today. In a recent report to Congress, the Federal Highway Administration reported that of the nation's 577,000 bridges, 226,000 (39% of the total) were classified as deficient, and that 134,000 (23% of the total) were classified as structurally deficient. Structurally deficient bridges are those that are closed, restricted to light vehicles only, or that require immediate rehabilitation to remain open. The damage on most of these bridges is caused by corrosion of reinforcing steel. The United States Department of Transportation has estimated that $90.9 billion will be needed to replace or repair the damage on these existing bridges.

Many solutions to this problem have been proposed, including higher quality concrete, improved construction practices, increased concrete cover over the reinforcing steel, specialty concretes, corrosion inhibiting admixtures, surface sealers, and electrochemical techniques such as cathodic protection and chloride removal. Of these techniques, only cathodic protection is capable of controlling corrosion of reinforcing steel over an extended period of time without complete removal of the salt contaminated concrete.

Cathodic protection reduces or eliminates corrosion of the steel by making it the cathode of an electrochemical cell. This results in cathodic polarization of the steel, which tends to suppress oxidation reactions (such as corrosion) in favor of reduction reactions (such as oxygen reduction). Cathodic protection was first applied to a reinforced concrete bridge deck in 1973. Since then, understanding and techniques have improved, and today cathodic protection has been applied to over one million square meters of concrete structures worldwide. Anodes, in particular, have been the subject of much attention, and several types of anodes have evolved for specific circumstances and different types of structures.

One type of anode which has recently been utilized for cathodic protection of reinforced concrete structures is thermally-sprayed zinc or zinc alloy. In this case thermal energy is used to convert a zinc or zinc alloy to its molten or semi-molten state, which is then deposited onto a prepared substrate. The zinc or zinc alloy may originally be in the form of powder, wire or rod. Thermal energy is generated by using combustible gases or an electric arc. As the zinc or zinc alloy is heated, it changes to a molten or plastic state, and is then accelerated by a compressed gas to the substrate surface. The particles strike the surface where they conform and adhere to the irregularities of the prepared surface and to each other. As the sprayed particles continue to impinge upon the substrate, they cool and build up, particle by particle, thus forming a coating. It has been determined in a recent survey that zinc anodes have been utilized for cathodic protection on 50,000 square meters of reinforced concrete structures.

This zinc or zinc alloy coating may then be used as an anode to supply current for the cathodic protection process. Such anodes may be used for either sacrificial or impressed current cathodic protection systems. Sacrificial cathodic protection systems are simpler and less expensive to install and maintain than impressed current systems, first because an ancillary power supply is not needed, and also because intentional shorts between the anode and steel are not detrimental to the system. For sacrificial systems a direct electrical connection is made between the anode and the reinforcing steel, and current flows spontaneously since the electrochemical reactions which cause current flow are thermodynamically favored. The amount of current which flows is uncontrolled, and is dependent mainly on the resistance of the concrete, the geometric relationship between the anode and steel, and the age of the system. The current which flows from sacrificial systems is sometimes insufficient to meet cathodic protection criteria. For this reason, the use of sacrificial systems is usually limited to locations where the concrete is very conductive due to high moisture and chloride content, such as in the seawater splash and tidal zone. Even so, cathodic protection systems utilizing zinc or zinc alloy anodes always experience a current decrease with time. After a few months, or at most, a very few years, current flow will decrease to the point where it is insufficient to meet cathodic protection criteria, at which point the anode will have to be removed and replaced. Removal and subsequent replacement of the anode by thermal spray process involves significant expense.

Where zinc and zinc alloy anodes are used in impressed current systems, a power supply is connected between the anode and the reinforcing steel. The power supply is used to increase the driving force (voltage) between the anode and cathode. In this case, the voltage may be increased so that the current needed for cathodic protection is maintained for a much longer period of time. Even so, after a few years the cathodic protection system voltage may exceed the design maximum of the power supply, usually 24 volts, and the current will thereafter become insufficient to meet cathodic protection criteria. This phenomenon of declining current from zinc and zinc alloy anodes has been a major limitation for the use of zinc and zinc alloy anodes, both for sacrificial and for impressed current cathodic protection systems. The exact cause of this phenomenon is not known, but is generally thought to be related to the build-up of anode corrosion products, such as zinc oxides and hydroxides, at the interface between the anode and the concrete.

SUMMARY OF THE INVENTION

The present invention relates to a method of cathodic protection of reinforced concrete, and more particularly, to a method of increasing current delivery from an anode used in a cathodic protection system.

The method of the present invention comprises applying a conductive metal onto an exposed surface of the concrete in an amount effective to form an anode on the surface. This establishes an interface between the anode and the concrete. A humectant is positioned at or near the interface. The humectant is present at or near the interface in a relatively large amount effective to increase the current delivery from the anode.

Preferably, the conductive metal is thermally applied to the reinforced concrete. More preferably, the conductive metal is zinc or a zinc alloy thermally applied to the reinforced concrete.

A preferred humectant is an inorganic salt, a hydrophilic polymer or colloid, or an organic liquid desiccant which is water or solvent soluble. Preferably, the humectant is positioned at or near the concrete interface in solution form.

Preferred humectants are selected from the group consisting of nitrites, nitrates, thiocyanates, thiosulfates, silicates, acetates, formates, lactates and hydrogels.

Preferably, the humectant is applied in solution form to the external surface of the anode after the metal of the anode has been thermally applied to the concrete. A thermally applied metal is inherently porous. The humectant, when applied to a surface of the thermally applied metal, quickly and effectively migrates through the metal to the interface between the metal and the concrete.

The present invention also resides in a cathodic protection system prepared by the above method, and to reinforced concrete structures comprising the cathodic protection system prepared by the above method.

The present invention also resides in a method of increasing the current delivery from a cathodic protection anode of a reinforced concrete structure comprising positioning at or near the interface between the anode and the concrete a humectant in an effective amount to increase said current delivery.

BRIEF DESCRIPTION OF THE DRAWINGS

Further features of the present invention will become apparent to those skilled in the art to which the present invention relates from reading the following specification with references to the accompanying drawings, in which.

DESCRIPTION OF THE PREFERRED EMBODIMENTS

Figure 1:
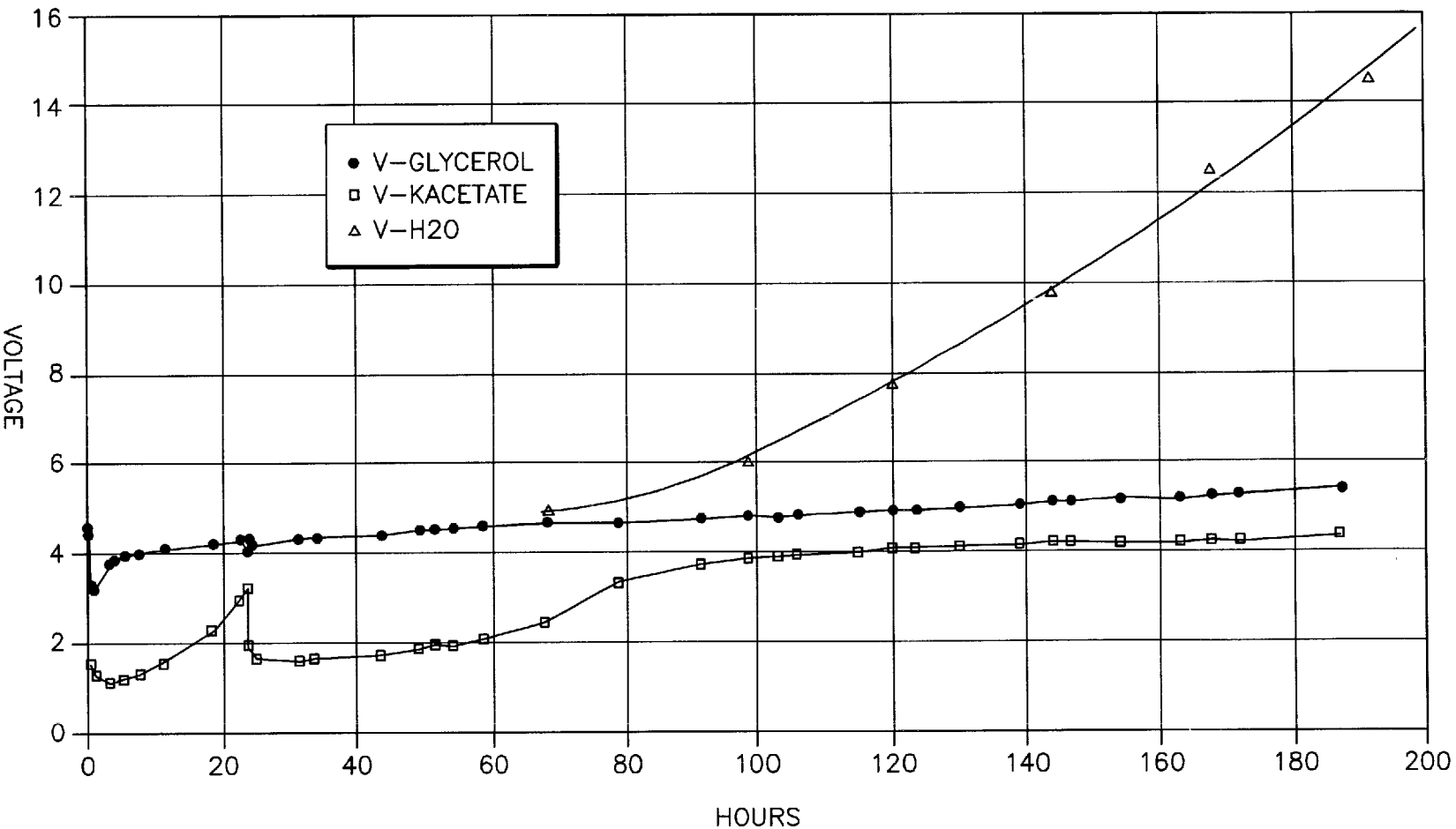
FIG. 1 is a graph showing voltage data points against hours run for newly constructed reinforced concrete surfaces treated with a humectant in accordance with the present invention compared with a newly constructed surface not so treated.

The present invention relates broadly to all reinforced concrete structures with which cathodic protection systems are useful.

Generally, the reinforcing metal in a reinforced structure is steel. However, other ferrous based metals can also be used.

The cathodic protection system of the present invention comprises at least one anode at a surface of the concrete structure. Multiple anodes at spaced intervals are commonly used.

Each anode is connected by a suitable conductor to the reinforcement of the concrete structure.

The cathodic protection system can be an impressed current system or a sacrificial cathodic protection system.

In an impressed current system, a power supply is positioned in the connection between the anode and the concrete reinforcement. The power supply provides an impressed flow of electrical current between the anode and the reinforcement. The impressed current flow is opposite and essentially equal to that which naturally occurs in a reinforced structure which has no cathodic protection, thus "passivating" the reinforcement. The net result is very little or no electrolytic action on the reinforcement, and little or no corrosion of the reinforcement occurs.

In a sacrificial cathodic protection system, corrosion of the anode is relied upon for current flow instead of a source of direct current flow. No power supply is used. The current flows spontaneously since the electrochemical reactions which cause current flow are thermodynamically favored.

A preferred metal for the metal anodes is zinc or zinc alloy. Other metals such as aluminum or an aluminum alloy have also been tested. These are sacrificial materials, but they can be used in both sacrificial cathodic protection systems and impressed current systems. A non-sacrificial material that has been used in impressed current systems is titanium or a titanium alloy.

Preferably, the metal anode is thermally applied to the reinforced structure. Details of such thermal application are disclosed in U.S. Pat. No. 4,506,485. The disclosure of this patent is incorporated herein by reference.

More preferably, the metal anode is applied by a thermal spray process such as combustion spraying, electric arc spraying, plasma spraying, high-energy plasma spraying, high-velocity oxyfuel (HVOF) spraying, and detonation gun spraying. Combustion spraying and electric arc spraying are cost-effective methods for application of cathodic protection anodes to field structures and are preferred. All of these processes produce a coating which is continuous and electrically conductive.

When the metal of the metal anode is applied to a concrete surface, it forms an interface with the concrete surface. The molten particles of metal from the thermal application process flow into irregularities in the concrete surface. On solidification, this results in a good bond between the anode and the concrete at the concrete-anode interface.

For purposes of the present application, the term "humectant" means broadly any liquid or any solid which is capable of delivery to or near the interface between the anode and the concrete and which takes up or promotes the retention of moisture. The humectant can be either deliquescent or hygroscopic. A deliquescent material is defined as one which becomes moist or liquified after exposure to humid air. A hygroscopic material is defined as one which is capable of absorbing water from the atmosphere.

It will be understood by those skilled in the art that the take-up of moisture can be by adsorption, absorption, or chemical action or reaction, e.g., bound water or water-of-hydration.

The humectant of the present invention should be relatively inert to the concrete and the anode. By "inert", it is meant a material which attacks neither the concrete nor the anode. Certain deliquescent or hygroscopic materials such as sulfuric acid and sodium hydroxide are highly acidic or basic and may attack the concrete or the anode. Such materials are not preferred.

Preferred humectants of the present invention are inorganic or organic salts, hydrophilic polymers or colloids, and organic liquid desiccants.

Preferably, the humectant of the present invention is one which is soluble in a liquid medium such as water or an organic solvent, e.g., alcohol. Most inorganic salts which are within the above-definitions of "hygroscopic" and "deliquescent" are water soluble. Preferred salts are nitrites, nitrates, thiocyanates, thiosulfates, and silicates. Other water soluble salts such as halogen salts and perchlorates can also be used. Also organic salts which are deliquescent or hygroscopic and within the above definitions, such as acetates, formates, and lactates can be used.

The humectant of the present invention can also be an organic or inorganic hydrophilic polymer or colloid, also known as a hydrocolloid or hydrogel. Such hydrophilic polymers or colloids are well known and combine with water to give viscous or structured solutions. One such hydrophilic polymer or colloid is a hydrogel based on an acrylic-sulfonamide copolymer. Examples of other hydrophilic polymers or colloids are inorganic polymers such as modified silicates, other synthetic polymers such as polyacrylates and styrene maleic anhydride copolymers, and polysaccharides such as cellulose derivatives (e.g., methyl, carboxymethyl and hydroxyethyl cellulose) and sodium alginates.

The humectant can also be an organic desiccant such as glycerol or a glycol, e.g., diethylene glycol and triethylene glycol.

Other suitable humectants will be apparent to those skilled in the art.

Preferably, the humectant of the present invention is delivered to or near the interface between the anode and the concrete by application to the anode as an aqueous solution, subsequent to application of the anode metal to the concrete and formation of the metal anode-concrete interface. In the present invention, the term "solution" includes colloidal solutions. The thermal process for applying metal to a concrete surface forms an anode which is inherently porous. The holes within the anode are small, but are of sufficient diameter to permit the passage of solutions, as well as colloidal particles, to the anode-concrete interface, for instance, by capillary attraction.

Alternatively, the humectant may be dissolved in an organic solvent, such as alcohol, for application to the surface of the anode, followed by transport to or near the interface between the anode and the concrete by capillary action.

The humectant may also be applied in solution or in solid form to the concrete surface prior to application of the anode metal to the concrete surface, but the preferred method of application is in an aqueous solution to the external surface of the thermally sprayed anode, as this method avoids any interference with the formation of the anode-concrete bond.

The humectants can be applied by spraying, brushing, or roller coating. Other methods of application of the humectants will be apparent to those skilled in the art.

If the anode coating is thick (greater than about 10 mils) it may be advantageous to produce thin spots in the anode coating to facilitate penetration of the humectant solution. This may be accomplished by drilling or abrading the anode coating in selected locations. It may also be accomplished by placing a template over the concrete substrate during the thermal application of the anode. A template in the form of a wire mesh with wires placed on four centimeter centerline spacing, for example, creates a pattern of thin areas in the anode through which the humectant solution more easily penetrates. The thin areas of anode should not comprise more than about 20% of the total anode area.

The humectants of the present invention, once delivered to or near the interface, remain at or near the interface for a long period of time. The diffusion coefficients for such materials in concrete are small making further penetration of the humectants into the concrete more difficult.

If the humectants are, over a long period of time, eluded from the interface between the anode and the concrete, for instance by rainfall, then the humectants can be reapplied to the exterior surface of the anode to again deposit at or near the interface between the anode and the concrete. The humectants can be reapplied as often as is necessary throughout the life of the cathodic protection system.

The principle advantage of the use of the humectants as taught by the present invention is that the current flow from an impressed current anode or a sacrificial anode will be enhanced. This is due to the presence of moisture at or near the interface between the anode and the concrete to reduce the resistance to current flow at the interface.

In a sacrificial anode cathodic protection system, it is theorized that the reason for the decrease of current which flows from a metal anode used sacrificially, is an increase in electrical resistance at the interface between the anode and the concrete. It is further theorized that this increase in resistance is due to the formation of products of corrosion, principally zinc oxides and hydroxides, that are neither deliquescent nor hygroscopic. After significant buildup of these corrosion products, a thin layer of dry, relatively high resistivity material exists within the electrical circuit. The layer of corrosion products has very little ability to attract and retain water. By positioning a humectant at or near the anode-concrete interface in accordance with the present invention, this increase in electrical resistance is counteracted.

In an impressed current system, the buildup of corrosion products at the anode may not be a problem. However, the use of the humectants of the present invention at the anode-concrete interface reduces the circuit resistance and results in adequate current flow at a lower system voltage and a more uniform current flow in the area covered by the system. This has the benefits of extending system life and improving system performance.

The amount of humectant required at or near the interface between the anode and the concrete varies widely depending upon the composition of the humectant, the type of reinforced concrete structure, its location, and other factors. Broadly, the amount of humectant is that effective to increase the current flow at the anode-concrete interface, and is relatively large compared for instance, to the amount of salt which may be present in concrete from such sources as seawater and deicers. Preferably, the humectant is applied in a range from about 20 grams per square meter of anode to about 500 grams per square meter of anode, dry basis. The preferred range of humectant is from about 80 to 300 grams per square meter. If too little humectant is applied, the amount of moisture retained at or near the interface will be insufficient to reduce the resistivity at the interface between the anode and concrete. If too much humectant is applied, this will result in an additional expense for no benefit.

The concentration of humectant in an aqueous solution for application to the surface of a zinc or zinc alloy may range from about 20 to about 400 grams per liter. If a solution is too dilute, then a large number of coats is required to deposit the required amount of humectant at or near the interface between the anode and the concrete. The upper end of the range of concentration of humectant in the aqueous solution is limited by the solubility of the humectant in water. When using an aqueous solution containing about 300 grams per liter of humectant, for concrete with a typical degree of dryness, about three coats of solution is required to deposit the preferred amount of humectant. The application is best done using brief drying periods between coats.

The cathodic protection system of the present invention may be energized immediately after application of the humectant. In some instances, it may be necessary to limit the current flow from an impressed current anode following application of the humectant. This may be done simply by installing a variable resistor in the wire between the anode and the cathode. The resistor may then be adjusted to limit the current to that sufficient to achieve cathodic protection criteria.

Alternatively, the type and concentration of humectant may be chosen to effectively control the cathodic protection current delivered. For example, a low concentration of humectant may first be applied to increase cathodic protection current slightly to a threshold level needed to achieve protection criteria. A higher current, which may shorten the effective life of the anode, is avoided. Later in the life of the system, a higher, concentration of humectant may be applied to increase the current again as the anode continues to age, or as a greater chloride concentration increases the current requirement. The judicious use of humectants in this way allows not only enhancement, but also control of current delivered from a sacrificial cathodic protection system, a benefit which was previously impossible.

It may also be beneficial to add agents which are pH buffers in the manner taught by the present invention. Buffers which maintain pH in the range of 10 to 13 also have the advantage of enhancing the flow of cathodic protection current by preventing the passivation of zinc, which occurs below pH 10. Buffers which function to maintain pH in this range include carbonates, silicates, phosphates, and borates. Such buffers may be added to the anode-concrete interface in the manner taught by the present invention either together with, or separate from, the humectants.

A principle advantage of the use of the humectants of the present invention is that the enhanced current flow in the system will continue to meet cathodic protection criteria for a much longer period of time, thus delaying the necessity to reapply the metal or metal alloy anode at frequent intervals.

It may be beneficial to deposit the humectant only after the cathodic protection current flow has dropped to an unacceptable level. In this way, current flow which is unnecessarily high may also be avoided.

It has been found that the humectants applied as taught by the present invention have an additional benefit. If a cathodic protection system utilizing a sacrificial anode such as a zinc or zinc alloy anode or a non-sacrificial anode such as a titanium anode is selectively wetted on only a portion of its surface, then current density is greatly enhanced in those wetted areas. This may cause large currents to flow in those select areas causing a high wear rate of the anode in those locations. This uneven wear rate may eventually cause the system to fail prematurely. By the use of the humectants as taught by the present invention, a more even distribution of current resulting in more uniform protection of the reinforcing steel and in extended service life of the cathodic protection system is achieved.

EXAMPLE I

A newly constructed 12×12×4 inch (30.5×30.5×10 centimeter) reinforced concrete specimen contained four 9 inch (23 centimeter) long No. 6 (19 mm diameter) reinforcing bars spaced on 3 inch (7.6 centimeter) centers. There was a 1 inch (2.5 centimeter) depth of concrete cover measured from the working surface of the specimen. The mix proportions for the concrete used in the specimen was as follows:

Type I Portland Cement—715 lb/yd$^3$

Frank Road Sand Fine Aggregate—1010 lb/yd$^3$

No. 57 American Aggregates Limestone—1830 lb/yd$^3$

Water—285 lb/yd$^3$

Air—6%

Following a 24-hour mold curing period, the specimen was placed in a controlled temperature/humidity room maintained at 100% relative humidity and 74° F. ±3° F. for 28 days. After the 28 day curing period, compressive strength was measured at 6440 psi.

The specimen was then coated with a pure zinc anode by combustion spray using an oxy-acetylene flame. Anode thickness was about 20 mils (0.5 mm).

The specimen was wetted with distilled water (which is non-conductive) and a constant current density of 3 mA/ft$^2$ was applied between the anode and reinforcing steel. Current was impressed upon the specimen to accelerate results. In this mode of operation, increasing resistance is observed to cause a voltage increase, whereas in galvanic mode of operation increasing resistance results in a current decrease. The specimen was operated at constant current in 35–40% relative humidity and about 74° F. ±3° F. for 200 hours, during which the operating voltage increased from 1.43 to 14.47 volts, as shown on FIG. 1.

The specimen was then cut to produce two 12×6×4 inch (30.5×15.2×10 centimeter) identical specimens. One of these specimens was then coated with a solution containing 300 grams of glycerol in a solution consisting of 70% isqpropyl alcohol and 30% water. A constant current density of 3 mA/ft$^2$ was again applied to the zinc anode. After 24 hours of operation, a second coat of the glycerol solution was applied to the surface of the zinc. After 200 hours of operation, the operating voltage of this specimen increased only from 1.13 to 5.53 volts. This result is shown on FIG. 1. It will be understood by those skilled in the art that if operated in a galvanic mode of operation, treatment with the humectant containing solution will result in much greater current delivery relative to an untreated specimen.

The second specimen produced by cutting the original specimen in two was coated with a solution containing 300 grams of potassium acetate in a solution consisting of 70% isopropyl alcohol and 30% water. A constant current density of 3 mA/ft$^2$ was again applied to the zinc anode. After 24 hours of operation at 35–40% relative humidity, a second coat of potassium acetate solution was applied to the surface of the zinc. After 200 hours of operation at 35–40% relative humidity, the operating voltage of this specimen increased only from 1.40 to 4.43 volts. This result is also shown on FIG. 1. Once again, it will be understood by those skilled in this art that if operated in a galvanic mode of operation, treatment with the humectant containing solution will result in much greater current delivery relative to an untreated specimen.

EXAMPLE II

A 12×12×4 inch (30.5×30.5×10 centimeter) reinforced concrete specimen was constructed as described in the previous example, except that 20 lb/yd$^3$ of chloride was added to the concrete mix as sodium chloride. The specimen was cured in the manner as previously described and the compressive strength of the concrete following the curing period was measured as 6525 psi. The specimen was also coated with a pure zinc anode by combustion spray using an oxy-acetylene flame. Anode thickness was about 20 mils (0.5 mm)

Figure 2:
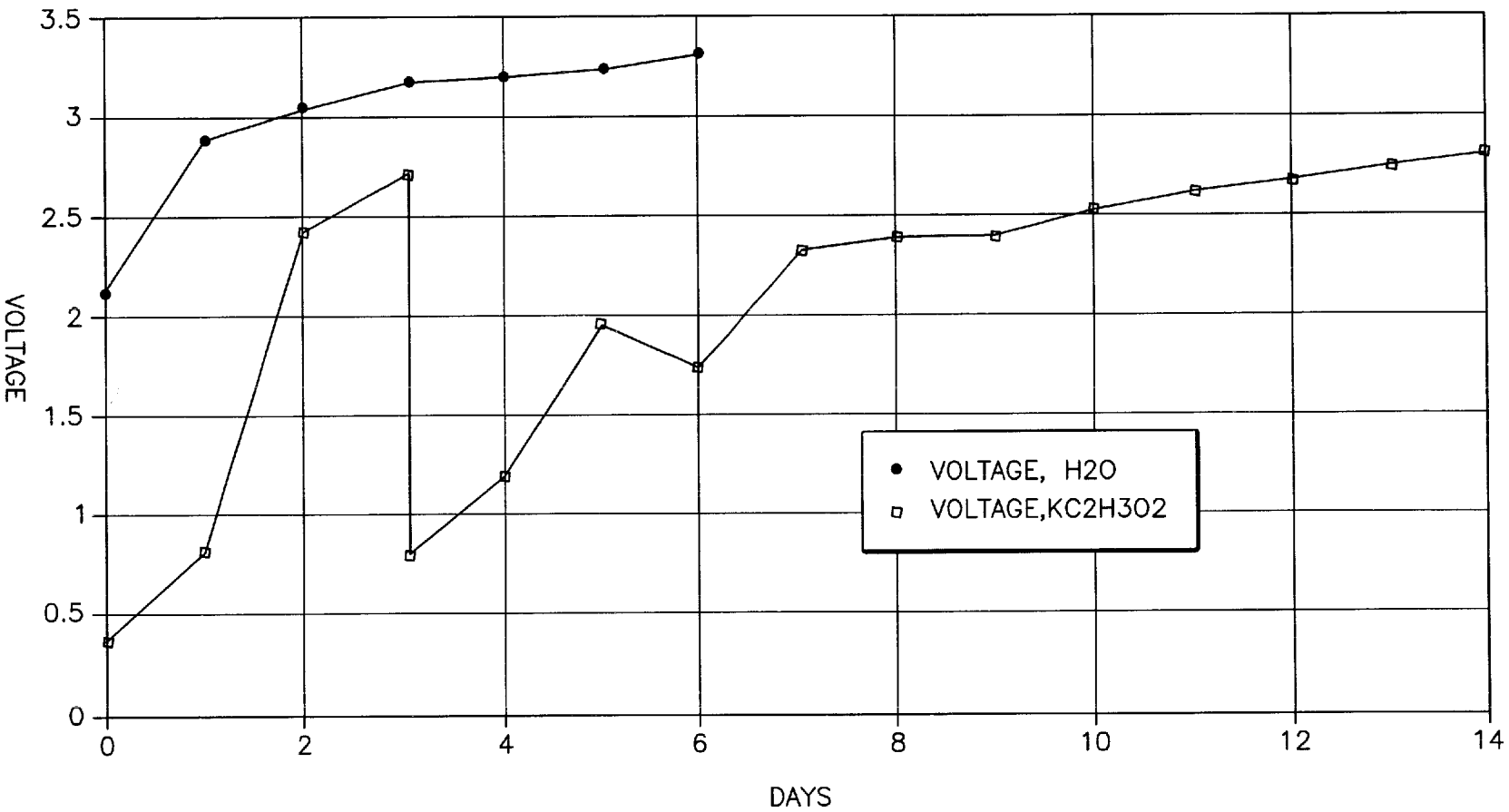
FIG. 2 is a graph showing voltage data points against hours run for an aged reinforced concrete surface treated with a humectant in accordance with the present invention compared with an aged surface not so treated.

This specimen was then operated at a constant current density of about 3 mA/ft$^2$ at 80% relative humidity for a period of 30 days. This resulted in electrochemical aging of the specimen to a total charge of 261 kC/m$^2$. After aging, the specimen was wetted with water and a constant current density of 3 mA/ft$^2$ was applied between the anode and reinforcing steel. The specimen was operated at constant current in 35–40% relative humidity and about 74° F. ±3° F. for six days, during which the operating voltage increased from 2.10 to 3.32 volts, as shown on FIG. 2.

This specimen was then coated with a solution containing 300 grams of potassium acetate in a solution consisting of 70% isopropyl alcohol and 30% water. A constant current density of 3 mA/ft$^2$ was again applied to the zinc anode. After three days of operation, a second coat of the potassium acetate solution was applied to the surface of the zinc. After 14 days of operation, the operating voltage of this specimen increased only from 0.38 to 2.86 volts. This result is shown on FIG. 2. It will be understood by those skilled in this art that if operated in a galvanic mode of operation, treatment with the humectant containing solution will result in much greater current delivery relative to an untreated specimen.

From the above description of the invention, those skilled in the art will perceive improvements, changes and modifications. Such improvements, changes and modifications within the skill of the art are intended to be covered by the appended claims.

Having described the invention, the following is claimed:

1. A method of cathodic protection of reinforced concrete comprising the steps of:

(a) thermally applying a sacrificial conductive metal onto an exposed surface of the reinforced concrete in an amount effective to form a sacrificial anode on such surface, wherein said conductive metal anode after thermal application is permeable, said conductive metal anode being bonded to the concrete surface and having an interface with the concrete surface;

(b) subsequently applying onto the exposed surface of said conductive metal anode a humectant in liquid form; and (c) allowing said humectant to migrate through the pores of said conductive metal anode to said anode and concrete interface, the permeability of the anode being effective to position at or near said interface humectant in the amount of at least 20 grams, dry basis, per square meter of anode, said humectant increasing the current delivery from said anode at said interface.

2. The method of claim 1 wherein said anode is zinc or a zinc alloy.

3. The method of claim 2 wherein said humectant is a water soluble or dispersible inorganic salt or organic salt, or organic liquid desiccant.

4. The method of claim 3 including the step of positioning a buffer at or near said interface In an effective amount to maintain a pH of 10 or more at or near said interface, said buffer being a base material positionable at said Interface by application in liquid form to the exposed surface of the anode and migration through the pores of the anode to said interface In said amount to maintain a pH of 10 or more.

* * * * *